US012384502B2

(12) United States Patent
Saruwatari et al.

(10) Patent No.: US 12,384,502 B2
(45) Date of Patent: Aug. 12, 2025

(54) OUTBOARD MOTOR AND BOAT

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 561 days.

(21) Appl. No.: 17/899,678

(22) Filed: Aug. 31, 2022

(65) Prior Publication Data

US 2023/0278689 A1 Sep. 7, 2023

(30) Foreign Application Priority Data

Mar. 3, 2022 (JP) ..... 2022-032382

(51) Int. Cl.
*B63H 20/10* (2006.01)
*B63H 20/32* (2006.01)

(52) U.S. Cl.
CPC ..... *B63H 20/10* (2013.01); *B63H 20/32* (2013.01)

(58) Field of Classification Search
CPC ..... B63H 20/10; B63H 20/32
See application file for complete search history.

(56) References Cited

U.S. PATENT DOCUMENTS 9,963,213 B1 * 5/2018 Jaszewski ..... B63H 20/10
2017/0129577 A1 5/2017 Mizutani

FOREIGN PATENT DOCUMENTS

JP 2006-240582 A 9/2006
JP 2017-087999 A 5/2017

* cited by examiner

*Primary Examiner* — Stephen P Avila
(74) *Attorney, Agent, or Firm* — Keating & Bennett, LLP

(57) ABSTRACT

An outboard motor includes a tilt shaft, an engine assembly, and a cowl. The tilt shaft defines a horizontal tilt axis during a tilting action of the outboard motor. At least a portion of the engine assembly is above the tilt axis in a tilt-down state of the outboard motor. The cowl accommodates at least a portion of the engine assembly. The tilt shaft includes a first shaft and a second shaft which are spaced apart and coaxial with each other. A portion of the cowl is between the first shaft and the second shaft.

13 Claims, 7 Drawing Sheets

OUTBOARD MOTOR AND BOAT

CROSS-REFERENCE TO RELATED APPLICATIONS

The present application claims priority under to Japanese Patent Application No. 2022-32382, filed Mar. 3, 2022. The contents of this application are incorporated herein by reference in their entirety.

BACKGROUND OF THE INVENTION

1. Field of the Invention

The present disclosure relates to an outboard motor and a boat.

2. Description of the Related Art

A boat includes a hull and an outboard motor attached to a rear portion of the hull. The outboard motor is a device that generates thrust to propel a boat.

The outboard motor is able to conduct a tilting action which is a rotation about a horizontal tilt axis (e.g., see JP2017-87999A). Due to the tilting action, the outboard motor can change the angle around the tilt axis in a range from the tilt-down state in which the propeller is located under the water surface to the tilt-up state in which the propeller is located above the water surface.

In the tilt-down state of the outboard motor, at least a portion of the engine assembly and at least a portion of the cowl accommodating the engine assembly are above the tilt axis. Therefore, as the tilt-down state is changed to the tilt-up state, these portions move forward and enter the upper space of the rear end of the hull (hereinafter referred to as the "rear end upper space"). In other words, the rear end upper space capable of receiving the above-described portions of the outboard motor when the outboard motor tilts up is secured in the hull.

SUMMARY OF THE INVENTION

In order to effectively utilize the space in the hull, it is preferable to reduce the amount of intrusion of the outboard motor into the rear end upper space when the outboard motor tilts up. Conventional outboard motors have room for improvement in reducing the amount of intrusion of the outboard motor into the rear end upper space when the outboard motor tilts up.

Preferred embodiments of the present invention disclose technologies able to solve the above-described problems.

Preferred embodiments of the present invention may be implemented in, e.g., the following aspects.

According to a preferred embodiment of the present invention, an outboard motor includes a tilt shaft, an engine assembly, and a cowl. The tilt shaft defines a horizontal tilt during a tilting action of the outboard motor. At least a portion of the engine assembly is above the tilt axis in a tilt-down state of the outboard motor. The cowl accommodates at least a portion of the engine assembly. The tilt shaft includes a first shaft and a second shaft which are spaced apart and coaxial with each other. A portion of the cowl is between the first shaft and the second shaft.

In the outboard motor, a portion of the cowl that accommodates the engine assembly is between the first shaft and the second shaft of the tilt shaft, so that the position of the cowl is able to be set relatively downward, and as a result, the position of the engine assembly is set relatively downward. Therefore, a height of the portion of the outboard motor located above the tilt axis is relatively low. Thus, the outboard motor is able to relatively reduce the amount of intrusion of the outboard motor into the rear end upper space of the hull when the outboard motor tilts up. Further, since the total height of the outboard motor is relatively low, it is possible to reduce the weight of the outboard motor.

In the above-described outboard motor, a portion of the engine assembly may be between the first shaft and the second shaft. The present configuration is able to set the position of the engine assembly farther downward, thus further lowering the height of the portion of the outboard motor located above the tilt axis. Therefore, the present configuration is able to further reduce the amount of intrusion of the outboard motor into the hull when the outboard motor tilts up, and further reduce the weight of the outboard motor by further reducing the total height of the outboard motor.

In the above-described outboard motor, the engine assembly may include an electrical component and an intake system component, and the portion of the engine assembly between the first shaft and the second shaft may include at least one of the electrical component and the intake system component. With the present configuration, it is possible to locate a portion the engine assembly between the first shaft and the second shaft of the tilt shaft without drastically changing the configuration of the engine assembly.

In the above-described outboard motor, the engine assembly may include an engine main body including a crank shaft including a spline. In the tilt-down state of the outboard motor, at least a portion of the spline may be lower than at least a portion of the tilt shaft. The present configuration is able to greatly lower the engine main body, and thus the engine assembly, to such a level that at least a portion of the spline of the crank shaft is lower than at least a portion of the tilt shaft, thus effectively reducing the height of the portion of the outboard motor located above the tilt axis. Accordingly, the present configuration is able to effectively reduce the amount of intrusion of the outboard motor into the hull when the outboard motor tilts up, and effectively reduce the weight of the outboard motor by further reducing the total height of the outboard motor.

In the above-described outboard motor, in the tilt-down state of the outboard motor, at least a portion of the spline may be lower than the tilt axis. The present configuration is able to greatly lower the position of the engine main body, and thus the engine assembly, to such a level that at least a portion of the spline of the crank shaft is lower than the tilt axis, thus further effectively reducing the height of the portion of the outboard motor located above the tilt axis. Accordingly, the present configuration is able to further effectively reduce the amount of intrusion of the outboard motor into the hull when the outboard motor tilts up, and further effectively reduce the weight of the outboard motor by further reducing the total height of the outboard motor.

In the above-described outboard motor, the engine assembly may include an engine main body including a crank shaft including a journal. In the tilt-down state of the outboard motor, at least a portion of the journal may be lower than at least a portion of the tilt shaft. The present configuration is able to greatly lower the position of the engine main body, and thus the engine assembly, to such a level that at least a portion of the journal of the crank shaft is lower than at least a portion of the tilt shaft, thus extremely effectively reducing the height of the portion of the outboard motor located above the tilt axis. Accordingly, the present configuration is able to extremely effectively reduce the amount of intrusion of the outboard motor into the hull when the outboard motor tilts up, and extremely effectively reduce the weight of the outboard motor by further reducing the total height of the outboard motor.

In the above-described outboard motor, in the tilt-down state of the outboard motor, at least a portion of the journal may be lower than the tilt axis. The present configuration is able to greatly lower the position of the engine main body, and thus the engine assembly, to such a level that at least a portion of the journal of the crank shaft is lower than the tilt axis, thus extremely effectively reducing the height of the portion of the outboard motor located above the tilt axis. Accordingly, the present configuration is able to extremely effectively reduce the amount of intrusion of the outboard motor into the hull when the outboard motor tilts up, and extremely effectively reduce the weight of the outboard motor by further reducing the total height of the outboard motor.

In the above-described outboard motor, the first shaft and the second shaft may be connected to each other below the first shaft and the second shaft. The present configuration is able to stabilize the position of the tilt shaft, and as a result, further stabilize the tilting action of the outboard motor in which the tilt shaft includes the first and second shafts which are spaced apart and coaxial with each other.

According to another preferred embodiment of the present invention, an outboard motor includes a tilt shaft and an engine assembly. The tilt shaft defines a horizontal tilt axis during a tilting action of the outboard motor. At least a portion of the engine assembly is above the tilt axis in a tilt-down state of the outboard motor. The engine assembly includes an engine main body including a crank shaft including a spline. The tilt shaft includes a first shaft and a second shaft which are spaced apart and coaxial with each other. A portion of the outboard motor is between the first shaft and the second shaft. In the tilt-down state of the outboard motor, at least a portion of the spline is lower than at least a portion of the tilt shaft.

Since a portion of the outboard motor is between the first shaft and the second shaft of the tilt shaft, the outboard motor is able to greatly lower the position of the engine main body, and thus the position of the engine assembly, to such a level that at least a portion of the spline of the crank shaft is lower than at least a portion of the tilt shaft, thus effectively reducing the height of the portion of the outboard motor located above the tilt axis. Accordingly, the present configuration is able to effectively reduce the amount of intrusion of the outboard motor into the hull when the outboard motor tilts up, and effectively reduce the weight of the outboard motor by further reducing the total height of the outboard motor.

In the above-described outboard motor, in the tilt-down state of the outboard motor, at least a portion of the spline may be lower than the tilt axis. The present configuration is able to greatly lower the position of the engine main body, and thus the engine assembly, to such a level that at least a portion of the spline of the crank shaft is lower than the tilt axis, thus further effectively reducing the height of the portion of the outboard motor located above the tilt axis. Accordingly, the present configuration is able to further effectively reduce the amount of intrusion of the outboard motor into the hull when the outboard motor tilts up, and further effectively reduce the weight of the outboard motor by further reducing the total height of the outboard motor.

According to yet another preferred embodiment of the present invention, an outboard motor includes a tilt shaft and an engine assembly. The tilt shaft defines a horizontal tilt axis during a tilting action of the outboard motor. At least a portion of the engine assembly is above the tilt axis in a tilt-down state of the outboard motor. The engine assembly includes an engine main body including a crank shaft including a journal. The tilt shaft includes a first shaft and a second shaft which are spaced apart and coaxial with each other. A portion of the outboard motor is between the first shaft and the second shaft. In the tilt-down state of the outboard motor, at least a portion of the journal is lower than at least a portion of the tilt shaft.

Since a portion of the outboard motor is between the first shaft and the second shaft of the tilt shaft, the outboard motor is able to greatly lower the position of the engine main body, and thus the position of the engine assembly, to such a level that at least a portion of the journal of the crank shaft is lower than at least a portion of the tilt shaft, thus effectively reducing the height of the portion of the outboard motor located above the tilt axis. Accordingly, the present configuration is able to effectively reduce the amount of intrusion of the outboard motor into the rear end upper space when the outboard motor tilts up, and effectively reduce the weight of the outboard motor by further reducing the total height of the outboard motor.

In the tilt-down state of the above-described outboard motor, at least a portion of the journal may be lower than the tilt axis. The present configuration is able to greatly lower the position of the engine main body, and thus the engine assembly, to such a level that at least a portion of the journal of the crank shaft is lower than the tilt axis, thus further effectively reducing the height of the portion of the outboard motor located above the tilt axis. Accordingly, the present configuration is able to further effectively reduce the amount of intrusion of the outboard motor into the hull when the outboard motor tilts up, and further effectively reduce the weight of the outboard motor by further reducing the total height of the outboard motor.

It should be noted that preferred embodiments of the present invention may be implemented in various aspects, e.g., in the form of an outboard motor and a boat equipped with an outboard motor and a hull, among other aspects.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
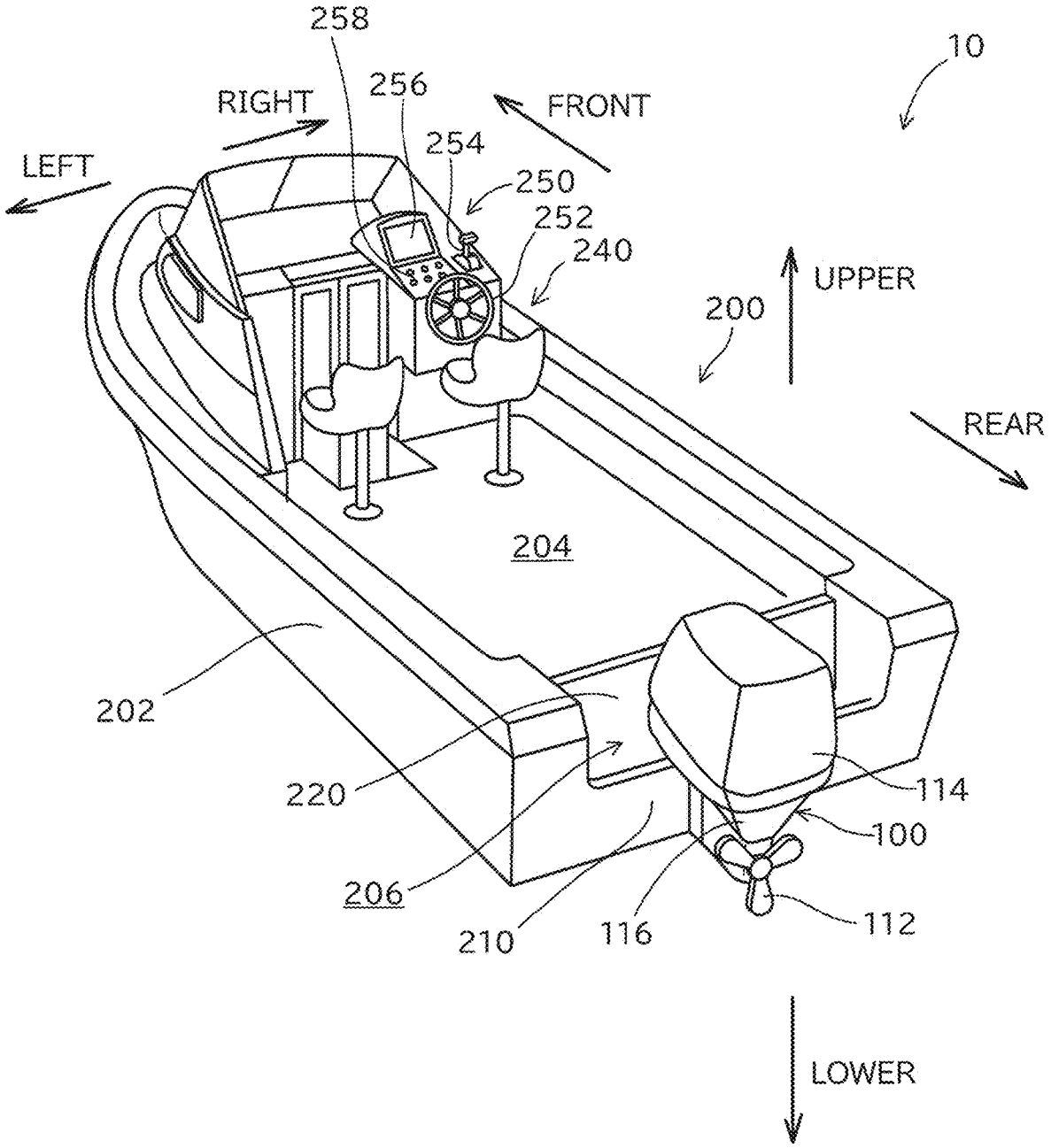
FIG. 1 is a perspective view schematically illustrating a configuration of a boat according to a first preferred embodiment of the present invention.

FIG. 1 is a perspective view schematically illustrating a configuration of a boat 10 according to a first preferred embodiment of the present invention. FIG. 1 and the other figures to be described below show arrows representing directions relative to the position of the boat 10. More specifically, each figure shows arrows respectively representing the front direction (FRONT), the rear direction (REAR), the left direction (LEFT), the right direction (RIGHT), the upper direction (UPPER), and the lower direction (LOWER). The front-rear direction, the left-right direction, and the upper-lower direction (vertical direction) are mutually perpendicular.

The boat 10 includes a hull 200 and an outboard motor 100.

The hull 200 is a portion of the boat 10 for occupants to ride in. The hull 200 includes a hull body 202 having a living space 204, a pilot seat 240 installed in the living space 204, and an operating device 250 installed near the pilot seat 240. The operating device 250 includes, e.g., a steering wheel 252, a shift throttle lever 254, a monitor 256, and an input device 258. The hull 200 includes a partition wall 220 to partition the rear end of the living space 204 and a transom 210 positioned at the rear end of the hull 200. In the front-rear direction, a space (hereinafter referred to as "rear end upper space 206") is provided between the transom 210 and the partition wall 220.

Figure 2:
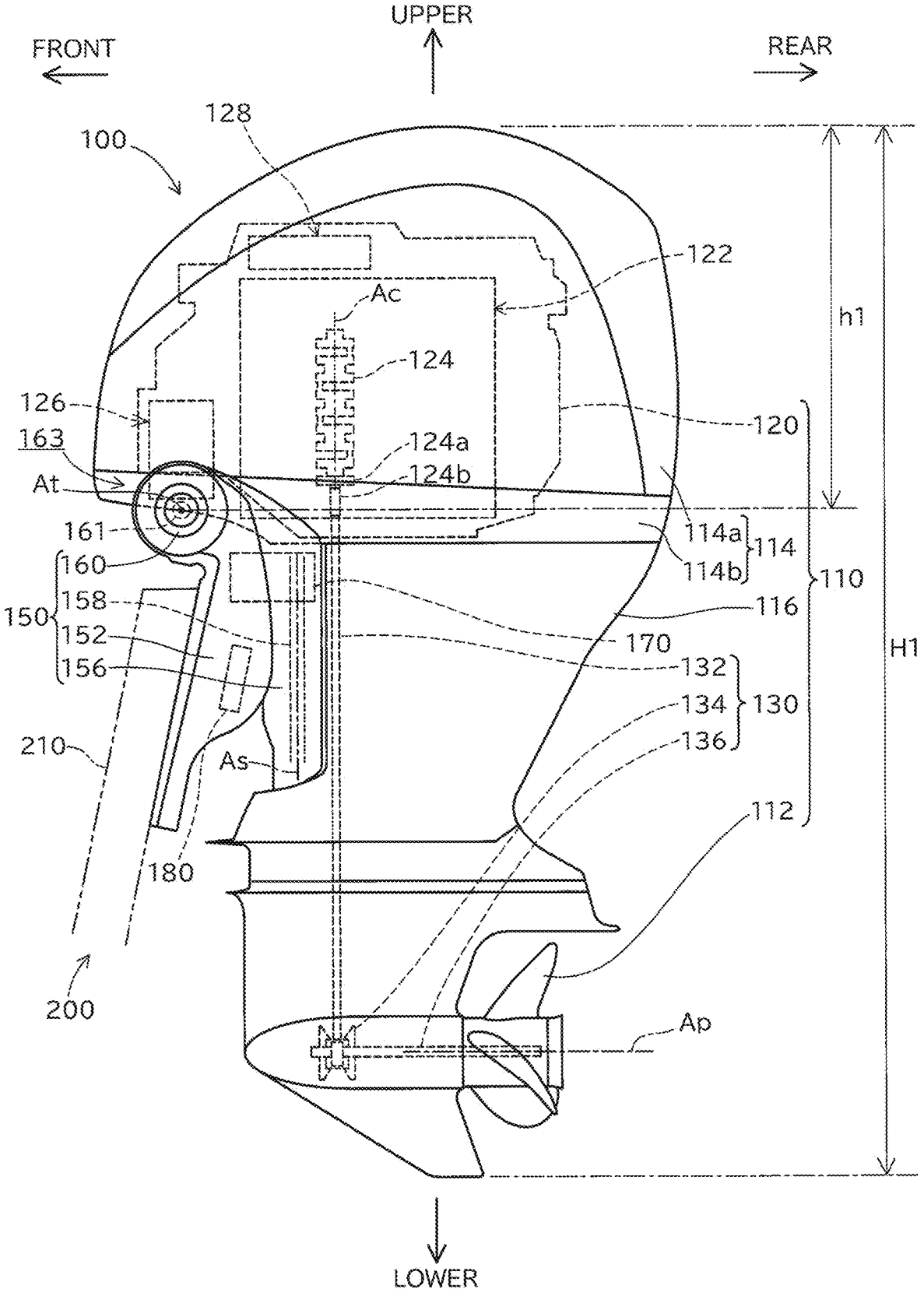
FIG. 2 is a side view schematically illustrating a configuration of an outboard motor.
Figure 3:
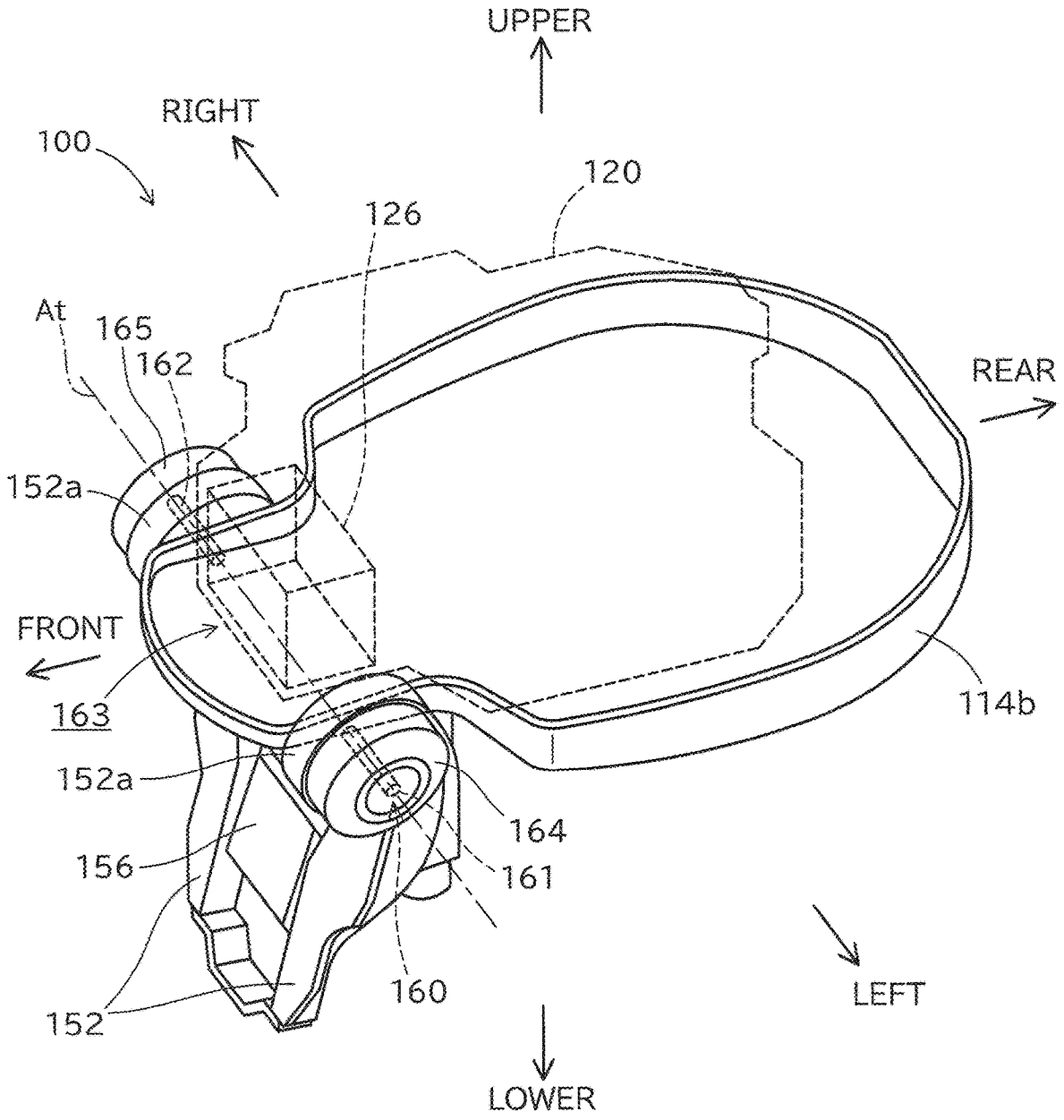
FIG. 3 is a perspective view schematically illustrating a configuration of a portion of the outboard motor.

FIG. 2 is a side view schematically illustrating a configuration of the outboard motor 100. FIG. 3 is a perspective view schematically illustrating a partial configuration of the outboard motor 100. The outboard motor 100 in the reference attitude will be described below unless otherwise specified. The reference attitude is an attitude in which the rotational axis Ac of the crank shaft 124, which will be described below, extends in the upper-lower direction, and the rotational axis Ap of a propeller shaft 136 extends in the front-rear direction. The front-rear direction, the left-right direction, and the upper-lower direction are defined based on the outboard motor 100 in the reference attitude.

The outboard motor 100 generates thrust to propel the boat 10. The outboard motor 100 is attached to the transom 210 at the rear of the hull 200. The outboard motor 100 includes an outboard motor main body 110, a suspension device 150, a steering device 170, and a tilting device 180.

The outboard motor main body 110 includes an engine assembly 120, a propeller 112, a power transmission mechanism 130, a cowl 114, and a casing 116.

The engine assembly 120 includes plurality of parts including an engine main body 122 as a main part. In addition to the engine main body 122, the engine assembly 120 includes an intake system component 126 (e.g., throttle bodies and superchargers) and an electrical component 128 (e.g., fuse box, ECU, and steering CU). The engine assembly 120 is disposed at a relatively upper position in the outboard motor 100.

At least a portion of the engine assembly 120 is accommodated within the cowl 114. The cowl 114 includes a lower cowl **114*b* defining the lower portion of the cowl 114 and an upper cowl 114*a* defining the upper portion of the cowl 114. The upper cowl 114*a* is detachably attached to the lower cowl 114*b***.

The engine main body 122 is a prime mover to generate power. The engine main body 122 includes, e.g., an internal combustion engine. The engine main body 122 includes a crank shaft 124 to convert reciprocating motion of a piston (not shown) into rotational motion. The crank shaft 124 has a rotational axis Ac that extends in the upper-lower direction. The crank shaft 124 includes a journal **124*a* which supports the crank shaft 124 at a bearing portion of a crank case (not shown), and a spline 124*b* including a plurality of vertical grooves to connect with the drive shaft 132** described below.

The propeller 112 is a rotating body including a plurality of blades. The propeller 112 is at a relatively lower position in the outboard motor 100. The propeller 112 generates thrust due to rotation thereof.

The power transmission mechanism 130 transmits power generated in the engine assembly 120 to the propeller 112. At least a portion of the power transmission mechanism 130 is accommodated in the casing 116. The power transmission mechanism 130 includes a drive shaft 132, a shift mechanism 134, and a propeller shaft 136.

The drive shaft 132 is a rod-shaped member and is disposed below the crank shaft 124 of the engine main body 122 in an attitude extending in the upper-lower direction. The upper end of the drive shaft 132 is connected to the spline **124*b* provided at the lower end of the crank shaft 124. Therefore, the drive shaft 132 rotates together with the rotation of the crank shaft 124**.

The propeller shaft 136 is a rod-shaped member and is disposed at a relatively lower position in the outboard motor 100 in an attitude extending in the front-rear direction. The rear end of the propeller shaft 136 projects to the outside of the casing 116, and the propeller 112 is attached to this rear end. The propeller 112 rotates together with the rotation of the propeller shaft 136 around the rotational axis Ap.

The shift mechanism 134 is connected to the lower end of the drive shaft 132 and to the front end of the propeller shaft 136. The shift mechanism 134 includes, e.g., a plurality of gears and a clutch to switch the engagement of the gears, and transmits the rotation of the drive shaft 132 to the propeller shaft 136 in such a manner that the rotation direction is able to be switched. When the shift mechanism 134 transmits the rotation of the drive shaft 132 to the propeller shaft 136 as a rotation in the normal rotation direction, the propeller 112 rotating in the normal rotation direction together with the propeller shaft 136 generates thrust in the forward direction. On the contrary, when the shift mechanism 134 transmits the rotation of the drive shaft 132 to the propeller shaft 136 as a rotation in the reverse rotation direction, the propeller 112 rotating in the reverse rotation direction together with the propeller shaft 136 generates a thrust in the rearward direction.

The suspension device 150 suspends the outboard motor main body 110 from the hull 200. The suspension device 150 includes a pair of left and right clamp brackets 152, a tilt shaft 160, a swivel bracket 156, and a steering shaft 158.

The pair of left and right clamp brackets 152 are disposed behind the hull 200 in a state separated from each other in the left-right direction, and are fixed to the transom 210 of the hull 200 by using, e.g., bolts. Each clamp bracket 152 includes a cylindrical supporting portion **152*a*** provided with a through hole extending in the left-right direction.

The tilt shaft 160 is a rod-shaped member. At least a portion of the tilt shaft 160 is rotatably supported in the through hole of the supporting portion **152*a* of the clamp bracket 152. The tilt axis At, which is the center line of the tilt shaft 160, defines an axis in the horizontal direction (left-right direction) during a tilting action of the outboard motor 100. The configuration of the tilt shaft 160** will be described below in detail.

The swivel bracket 156 is sandwiched between the pair of clamp brackets 152, and is supported by the supporting portion 152*a* of the clamp bracket 152 via the tilt shaft 160 in such a manner that the swivel bracket 156 is able to rotate around the tilt axis At. The swivel bracket 156 is rotationally driven about the tilt axis At with respect to the clamp bracket 152 by the tilting device 180 including an actuator such as a hydraulic cylinder. The tilting device 180 is, e.g., disposed below the tilt shaft 160 in the space between the pair of clamp brackets 152.

The steering shaft 158 is a rod-shaped member. The steering shaft 158 is supported by the swivel bracket 156 so as to be rotatable about the steering axis As, which is the center line of the steering shaft 158, in an attitude extending in the upper-lower direction. The steering shaft 158 is rotationally driven about the steering axis As with respect to the swivel bracket 156 by the steering device 170 including an actuator such as a hydraulic cylinder. The steering device 170 is, e.g., disposed below the tilt shaft 160 in a space between the pair of clamp brackets 152.

The outboard motor main body 110 is fixed to the steering shaft 158. Therefore, when the steering shaft 158 rotates around the steering axis As with respect to the swivel bracket 156, the outboard motor main body 110 fixed to the steering shaft 158 also rotates around the steering axis As. This changes the direction of the thrust generated by the propeller 112 relative to the direction of the hull 200, thus steering the boat 10.

When the swivel bracket 156 rotates around the tilt axis At with respect to the clamp bracket 152, the steering shaft 158 supported by the swivel bracket 156 and the outboard motor main body 110 fixed to the steering shaft 158 also rotate around the tilt axis At. This achieves the tilting action of rotating the outboard motor main body 110 in the upper-lower direction with respect to the hull 200. Due to this tilting action, the outboard motor 100 is able to change the angle around the tilt axis At of the outboard motor main body 110 in the range from the tilt-down state in which the propeller 112 is located under the water surface (the state in which the outboard motor 100 is in the reference attitude) to the tilt-up state in which the propeller 112 is located above the water surface. The tilting device 180 also performs a trimming action to adjust the attitude of the boat 10 during travel by adjusting the angle around the tilt axis At of the outboard motor main body 110.

Figure 4:
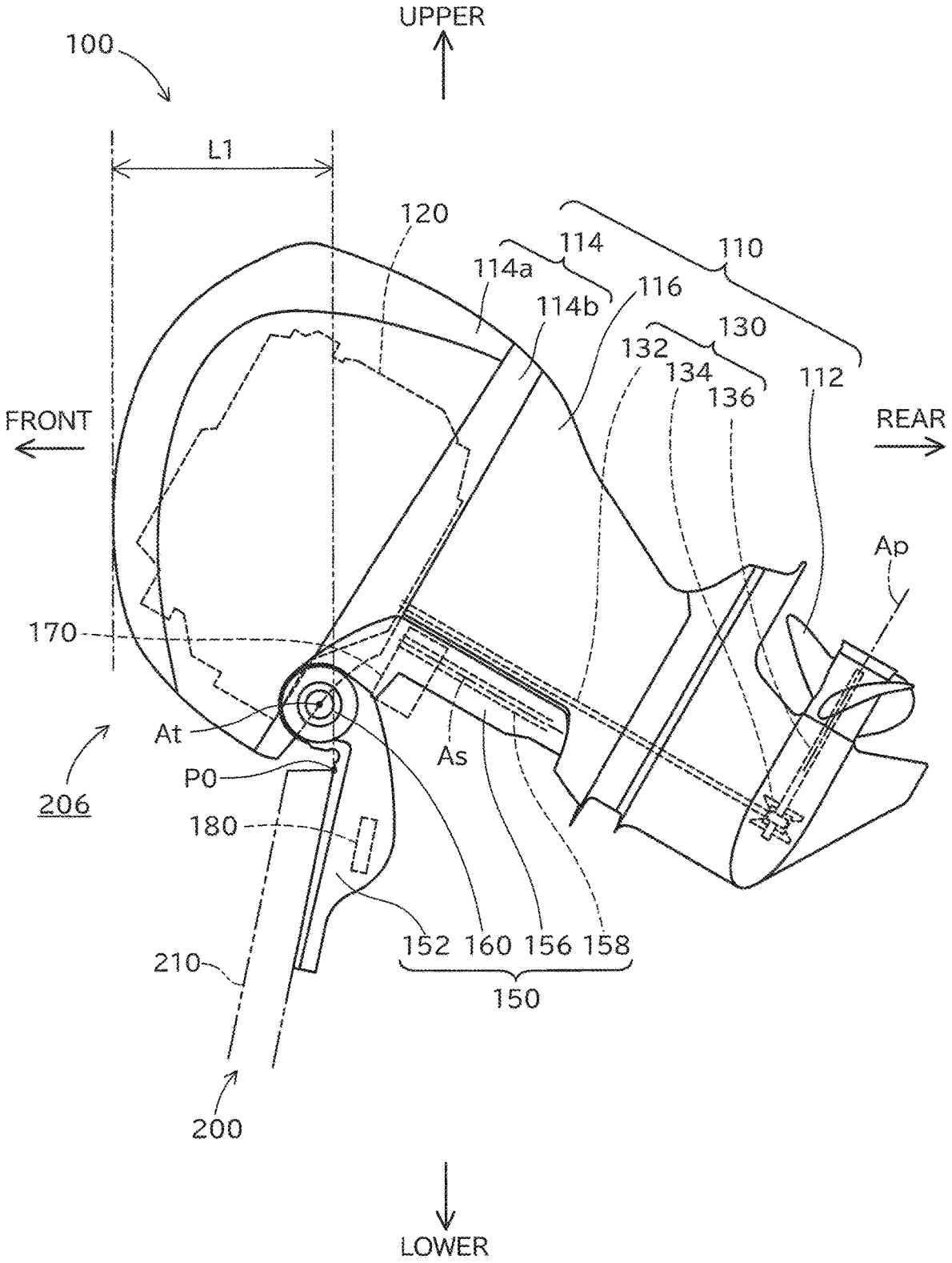
FIG. 4 is a side view illustrating a configuration of the outboard motor in the tilt-up state.

FIG. 4 is a side view illustrating the configuration of the outboard motor 100 in the tilt-up state. In the outboard motor 100 in the tilt-down state shown in FIG. 2, the position along the upper-lower direction (vertical directional position) of at least a portion of the engine assembly 120 and at least a portion of the cowl 114 accommodating the engine assembly 120 is above the vertical directional position of the tilt axis At. Therefore, as shown in FIG. 4, these portions move forward and enter the rear end upper space 206 of the hull 200 in accordance with the transition from the tilt-down state to the tilt-up state. In other words, the rear end upper space 206 able to receive the portion of the outboard motor 100 when the outboard motor 100 tilts up is secured in the hull 200. Hereinafter, in the outboard motor 100 in the tilt-up state, the distance along the front-rear direction from the reference point P0, which is the rear end point of the upper surface of the transom 210, to the most forward end position of the outboard motor 100 is referred to as the amount of intrusion L1 of the outboard motor 100 in the tilt-up state.

Next, a detailed configuration around the tilt shaft 160 in the outboard motor 100 of the first preferred embodiment of the present invention will be described. As shown in FIG. 3, the tilt shaft 160 includes a first shaft 161 and a second shaft 162 which are spaced apart from each other and coaxial with each other. Each of the first shaft 161 and the second shaft 162 is a rod-shaped member extending in the left-right direction. The first shaft 161 is supported by the supporting portion 152*a* of the left clamp bracket 152, and the second shaft 162 is supported by the supporting portion 152*a* of the right clamp bracket 152.

Further, the tilt shaft 160 includes a first cap 164 that is disk-shaped or substantially disk-shaped on the outside (left side) of the supporting portion 152*a* of the left clamp bracket 152, and a second cap 165 that is disk-shaped or substantially disk-shaped on the outside (right side) of the supporting portion 152*a* of the right clamp bracket 152. The first cap 164 is connected to the first shaft 161 and rotates together with the first shaft 161. The second cap 165 is connected to the second shaft 162 and rotates together with the second shaft 162.

A space 163 exists between the first shaft 161 and the second shaft 162 of the tilt shaft 160. This space 163 overlaps the first shaft 161 and the second shaft 162 in the left-right direction view. A portion of the cowl 114 (lower cowl 114*b*) accommodating the engine assembly 120 is disposed in this space 163. In other words, a portion of the cowl 114 overlaps the first shaft 161 and the second shaft 162 in the left-right direction view. Further, in the present preferred embodiment, the intake system component 126 as an element of the engine assembly 120 is disposed in the space 163 between the first shaft 161 and the second shaft 162.

As described above, in the outboard motor 100 of the present preferred embodiment, a portion of the engine assembly 120 is disposed between the first shaft 161 and the second shaft 162 of the tilt shaft 160. As a result, the position of the engine assembly 120 is set relatively downward to reduce the amount of intrusion L1 of the outboard motor 100 into the hull 200 when the outboard motor 100 tilts up. This point will be described in detail below.

Figure 5:
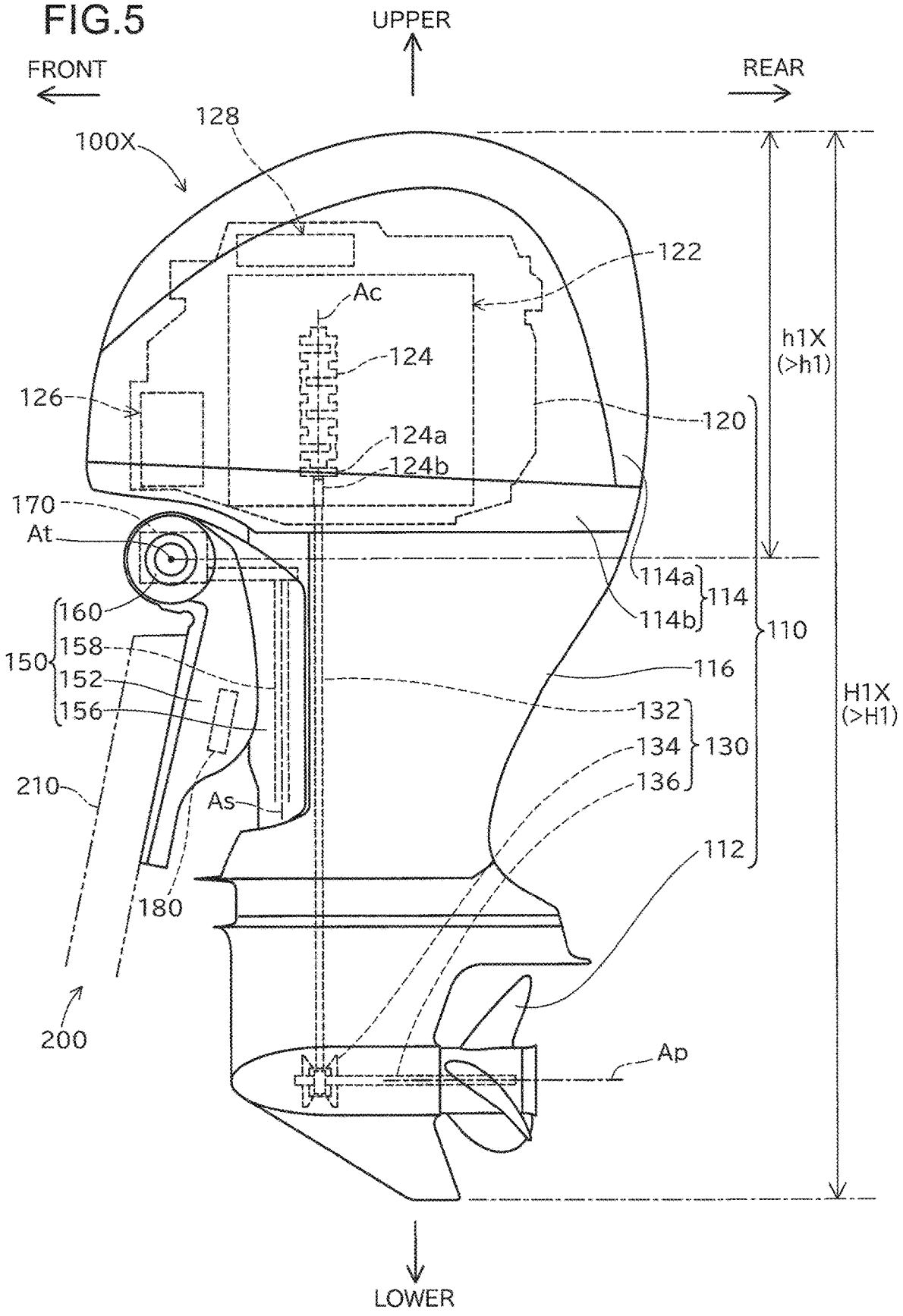
FIG. 5 is a side view illustrating a configuration of an outboard motor of a comparative example.
Figure 6:
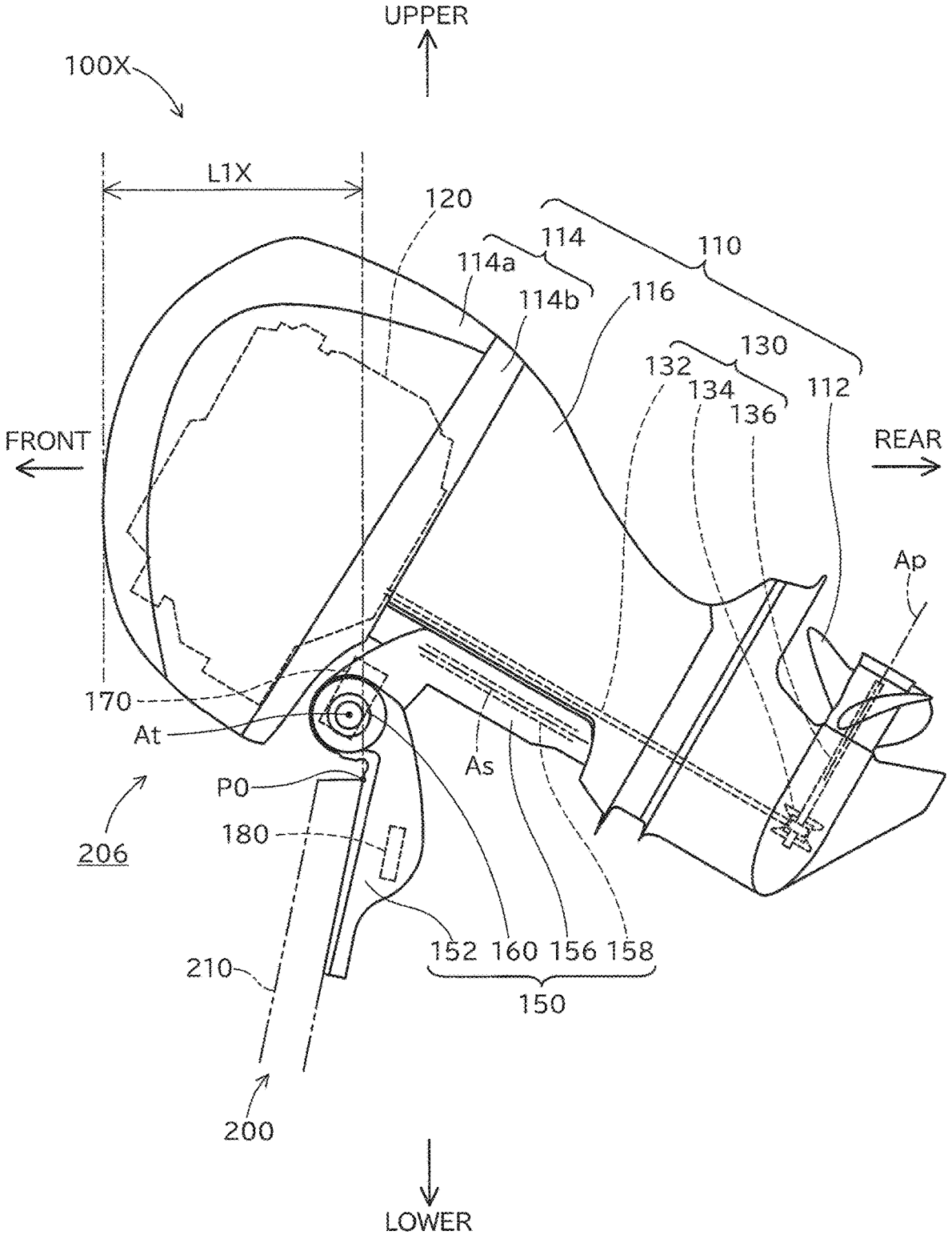
FIG. 6 is a side view illustrating a configuration of the outboard motor of the comparative example in the tilt-up state.

FIG. 5 is a side view illustrating a configuration of an outboard motor 100X of a comparative example. FIG. 6 is a side view illustrating a configuration of the outboard motor 100X of the comparative example in the tilt-up state. In the outboard motor 100X of the comparative example, the tilt shaft 160 is not divided into the first shaft 161 and the second shaft 162. Therefore, the cowl 114 and the engine assembly 120 are positioned relatively high so as to avoid interference with the tilt shaft 160. Thus, the height h1X of the portion of the outboard motor 100X located above the tilt axis At is relatively high. As a result, as shown in FIG. 6, the amount of intrusion L1X of the outboard motor 100X into the hull 200 when the outboard motor 100X tilts up is relatively large. In addition, the outboard motor 100X is relatively heavy since the total height H1X of the outboard motor 100X is also relatively high.

On the contrary, in the outboard motor 100 of the present preferred embodiment, since a portion of the engine assembly 120 is disposed between the first shaft 161 and the second shaft 162 of the tilt shaft 160, the position of the engine assembly 120 is set relatively downward. As shown in FIG. 2, in the present preferred embodiment, the position of the engine assembly 120 is set downward to such a level that the vertical directional position of at least a portion of the spline 124*b* of the crank shaft 124 comes to be lower than the vertical directional position of at least a portion of the tilt shaft 160. It is more preferable that the position of the engine assembly 120 is set downward to such a level that the vertical directional position of at least a portion of the spline

124*b* of the crank shaft 124 comes to be lower than the vertical directional position of the tilt axis At. It is also more preferable that the position of the engine assembly 120 is set downward to such a level that the vertical directional position of at least a portion of the journal 124*a* of the crank shaft 124 comes to be lower than the vertical directional position of at least a portion of the tilt shaft 160. It is still more preferable that the position of the engine assembly 120 is set downward to such a level that the vertical directional position of at least a portion of the journal 124*a* of the crank shaft 124 comes to be lower than the vertical directional position of the tilt axis At.

As described above, in the outboard motor 100 of the present preferred embodiment, since the position of the engine assembly 120 is set relatively downward, the height hi of the portion of the outboard motor 100 located above the tilt axis At is relatively low. Therefore, according to the outboard motor 100 of the present preferred embodiment, as shown in FIG. 4, the amount of intrusion L1 of the outboard motor 100 into the hull 200 when the outboard motor 100 tilts up is relatively small. In addition, the weight of the outboard motor 100 is reduced since the total height H1 of the outboard motor 100 is also relatively low.

In the outboard motor 100 of the present preferred embodiment, the intake system component 126 is disposed between the first shaft 161 and the second shaft 162 of the tilt shaft 160. In this manner, it is possible to implement a configuration in which a portion of the engine assembly 120 is disposed between the first shaft 161 and the second shaft 162 of the tilt shaft 160 without drastically changing the configuration of the engine assembly 120.

Figure 7:
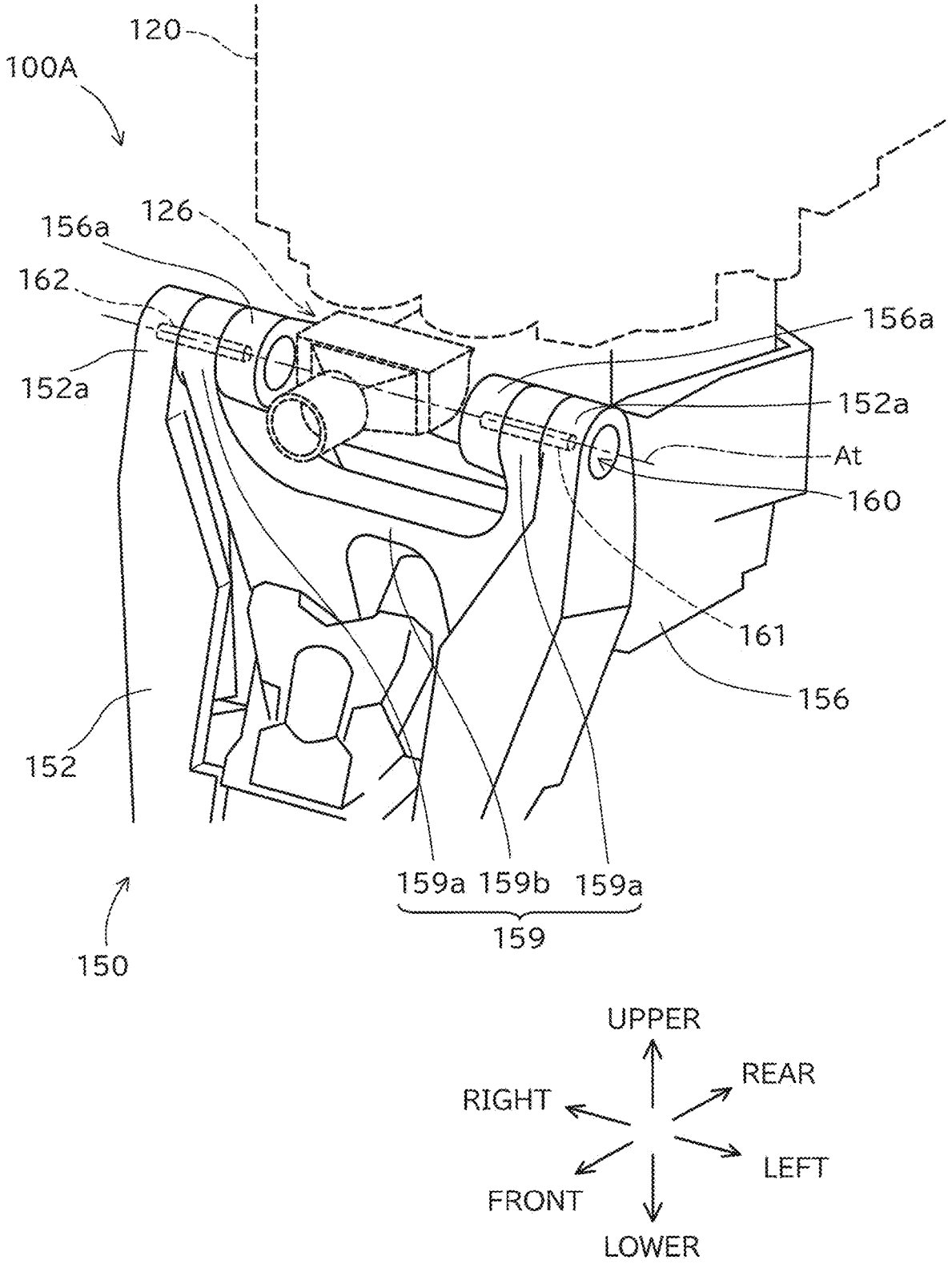
FIG. 7 is a perspective view schematically illustrating a configuration of a portion of an outboard motor according to a second preferred embodiment of the present invention.

FIG. 7 is a perspective view schematically illustrating a configuration of a portion of an outboard motor 100A according to a second preferred embodiment of the present invention. Hereinafter, in the configurations of the outboard motor 100A of the second preferred embodiment, the same configurations as those of the outboard motor 100 of the first preferred embodiment described above are omitted as appropriate by assigning the same reference numerals.

The outboard motor 100A of the second preferred embodiment differs from the outboard motor 100 of the first preferred embodiment in that the suspension device 150 includes a connecting member 159. The connecting member 159 includes a pair of cylindrical supporting portions 159*a* having through holes extending in the left-right direction, and a connecting portion 159*b* connecting the pair of supporting portions 159*a* to each other. Each supporting portion 159*a* of the connecting member 159 is sandwiched between the supporting portion 152*a* of the clamp bracket 152 and the supporting portion 156*a* of the swivel bracket 156. The connecting member 159 is supported by the supporting portion 152*a* of the clamp bracket 152 via the tilt shaft 160 (the first shaft 161 and the second shaft 162) in each supporting portion 159*a*.

As described above, in the outboard motor 100A of the second preferred embodiment, the suspension device 150 includes the connecting member 159. Therefore, the first shaft 161 and the second shaft 162 of the tilt shaft 160 are connected to each other through the connecting member 159 below the first shaft 161 and the second shaft 162. Therefore, the outboard motor 100A of the second preferred embodiment is able to stabilize the position of the tilt axis At in a configuration in which the tilt shaft 160 includes the first shaft 161 and the second shaft 162 which are spaced apart and coaxial with each other, thus further stabilizing the tilting action of the outboard motor 100A.

The technology disclosed herein is not limited to the above-described preferred embodiments, and can be modified into various forms without departing from the spirit of the technology, and the following modifications are also possible.

The structure of the boat 10 of the above-described preferred embodiments are merely examples and can be varied in various ways. For example, in the above-described preferred embodiments, the intake system component 126 as an element of the engine assembly 120 is disposed between the first shaft 161 and the second shaft 162 of the tilt shaft 160, but the electrical component 128 may be disposed between the first shaft 161 and the second shaft 162 in place of the intake system component 126 or together with the intake system component 126. This also provides a configuration in which a portion of the engine assembly 120 is disposed between the first shaft 161 and the second shaft 162 of the tilt shaft 160 without drastically changing the configuration of the engine assembly 120. Components or portions other than the intake system component 126 and the electrical component 128 of the engine assembly 120 may be disposed between the first shaft 161 and the second shaft 162.

A portion of the engine assembly 120 may not be disposed between the first shaft 161 and the second shaft 162 of the tilt shaft 160, but at least a portion of the cowl 114 may be disposed therebetween. Such a configuration is able to also set the position of the cowl 114 relatively downward, thus set the position of the engine assembly 120 relatively downward, and make the amount of intrusion L1 of the outboard motor 100 into the hull 200 when the outboard motor 100 tilts up relatively small, thus reducing the weight of the outboard motor 100 by reducing the total height of the outboard motor 100.

Portions of the outboard motor 100 other than the portions described above may be disposed between the first shaft 161 and the second shaft 162 of the tilt shaft 160. Such a configuration also lowers the height of the portion of the outboard motor 100 positioned above the tilt axis At to relatively reduce the amount of intrusion L1 of the outboard motor 100 into the hull 200 when the outboard motor 100 tilts up, thus reducing the weight of the outboard motor 100 by reducing the total height of the outboard motor 100.

In the second preferred embodiment, the first shaft 161 and the second shaft 162 of the tilt shaft 160 are connected to each other via the connecting member 159, but the first shaft 161 and the second shaft 162 may be connected to each other via other portions of the tilt shaft 160 without using the connecting member 159.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a tilt shaft defining a horizontal tilt axis during a tilting action of the outboard motor;

an engine assembly at least a portion of which is above the tilt axis in a tilt-down state of the outboard motor; and a cowl accommodating at least a portion of the engine assembly; wherein the tilt shaft includes a first shaft and a second shaft spaced apart and coaxial with each other; and a portion of the cowl is between the first shaft and the second shaft.

2. The outboard motor according to claim 1, wherein a portion of the engine assembly is between the first shaft and the second shaft.

3. The outboard motor according to claim 2, wherein the engine assembly includes an electrical component and an intake system component; and the portion of the engine assembly between the first shaft and the second shaft is at least one of the electrical component and the intake system component.

4. The outboard motor according to claim 1, wherein the engine assembly includes an engine main body including a crank shaft including a spline; and in the tilt-down state of the outboard motor, at least a portion of the spline is lower than at least a portion of the tilt shaft.

5. The outboard motor according to claim 4, wherein, in the tilt-down state of the outboard motor, at least a portion of the spline is lower than the tilt axis.

6. The outboard motor according to claim 1, wherein the engine assembly includes an engine main body including a crank shaft including a journal; and in the tilt-down state of the outboard motor, at least a portion of the journal is lower than at least a portion of the tilt shaft.

7. The outboard motor according to claim 6, wherein, in the tilt-down state of the outboard motor, at least a portion of the journal is lower than the tilt axis.

8. The outboard motor according to claim 1, wherein the first shaft and the second shaft are connected to each other below the first shaft and the second shaft.

9. An outboard motor comprising:

a tilt shaft defining a horizontal tilt axis during a tilting action of the outboard motor; and an engine assembly at least a portion of which is above the tilt axis in a tilt-down state of the outboard motor; wherein the engine assembly includes an engine main body including a crank shaft including a spline;

the tilt shaft includes a first shaft and a second shaft which are spaced apart and coaxial with each other;

a portion of the outboard motor is between the first shaft and the second shaft; and in the tilt-down state of the outboard motor, at least a portion of the spline is lower than at least a portion of the tilt shaft.

10. The outboard motor according to claim 9, wherein, in the tilt-down state of the outboard motor, at least a portion of the spline is lower than the tilt axis.

11. An outboard motor comprising:

a tilt shaft defining a horizontal tilt axis during a tilting action of the outboard motor; and an engine assembly at least a portion of which is above the tilt axis in a tilt-down state of the outboard motor; wherein the engine assembly includes an engine main body including a crank shaft including a journal;

the tilt shaft includes a first shaft and a second shaft which are spaced apart and coaxial with each other;

a portion of the outboard motor is between the first shaft and the second shaft; and in the tilt-down state of the outboard motor, at least a portion of the journal is lower than at least a portion of the tilt shaft.

12. The outboard motor according to claim 11, wherein, in the tilt-down state of the outboard motor, at least a portion of the journal is lower than the tilt axis.

13. A boat comprising:

a hull; and the outboard motor according to claim 1 attached to a rear portion of the hull.

* * * * *